US006463852B1

(12) United States Patent
Chagnon et al.

(10) Patent No.: US 6,463,852 B1
(45) Date of Patent: Oct. 15, 2002

(54) FLUID-LOADED TENSIONING DEVICE FOR PRINTING FORMS ON ROTARY PRINTING MACHINES

(75) Inventors: Franck Chagnon, S'lev d'esserent; Bruno Dautancourt, Lamorlaye, both of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 33 days.

(21) Appl. No.: 09/713,482

(22) Filed: Nov. 15, 2000

(30) Foreign Application Priority Data

Nov. 15, 1999 (DE) ..... 199 54 858
Jun. 19, 2000 (FR) ..... 00 07793

(51) Int. Cl.[7] ..... B41F 27/12
(52) U.S. Cl. ..... 101/415.1; 101/378
(58) Field of Search ..... 101/415.1, 378, 101/382.1, 383

(56) References Cited

U.S. PATENT DOCUMENTS 5,359,933 A * 11/1994 Blaser et al. ..... 101/415.1
5,396,843 A * 3/1995 Durr ..... 101/378
5,735,211 A 4/1998 Parks et al. ..... 101/415.1
6,047,641 A * 4/2000 Chagnon ..... 101/415.1

FOREIGN PATENT DOCUMENTS

EP 0 842 773 A1 5/1998
EP 0 884 176 A1 12/1998

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A tensioning device for a printing form on a jacket surface of a printing unit cylinder in a printing unit of a rotary printing machine, the printing unit cylinder being formed with a tensioning gap for receiving ends of the printing form therein, a tensioning shaft being received in a bore formed in the printing unit cylinder, the tensioning shaft being held under pretensioning by tensioning elements, includes fluid-loaded cylinders disposed on the tensioning shaft for respectively locking and unlocking a tensioning element on the tensioning shaft, and a separate actuating cylinder for setting an operating pressure of the fluid-loaded cylinders; a printing unit cylinder with the tensioning device; a printing unit with a printing unit cylinder; and a printing unit cylinder cooperating with a transfer cylinder.

18 Claims, 7 Drawing Sheets

Fig.2.1
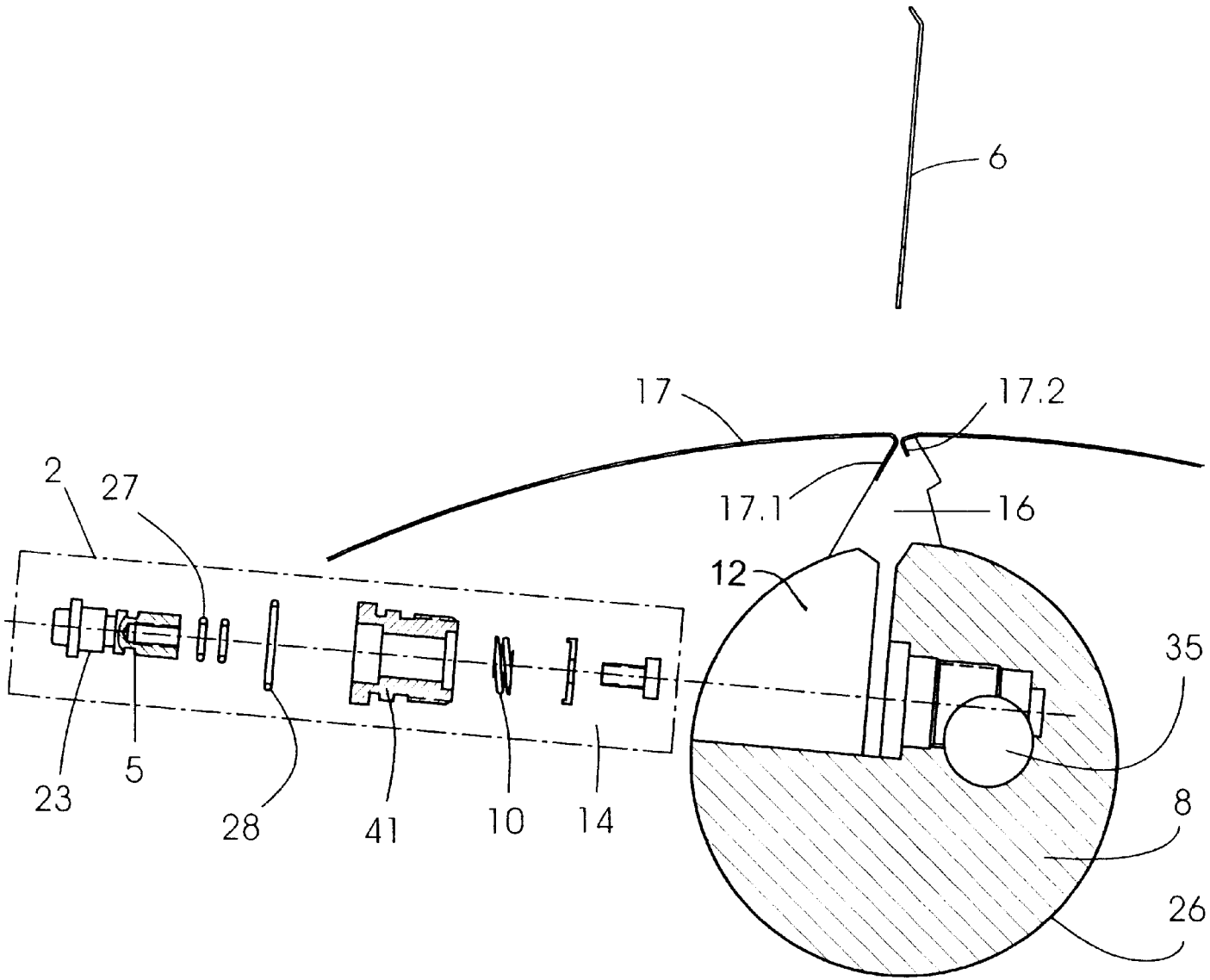

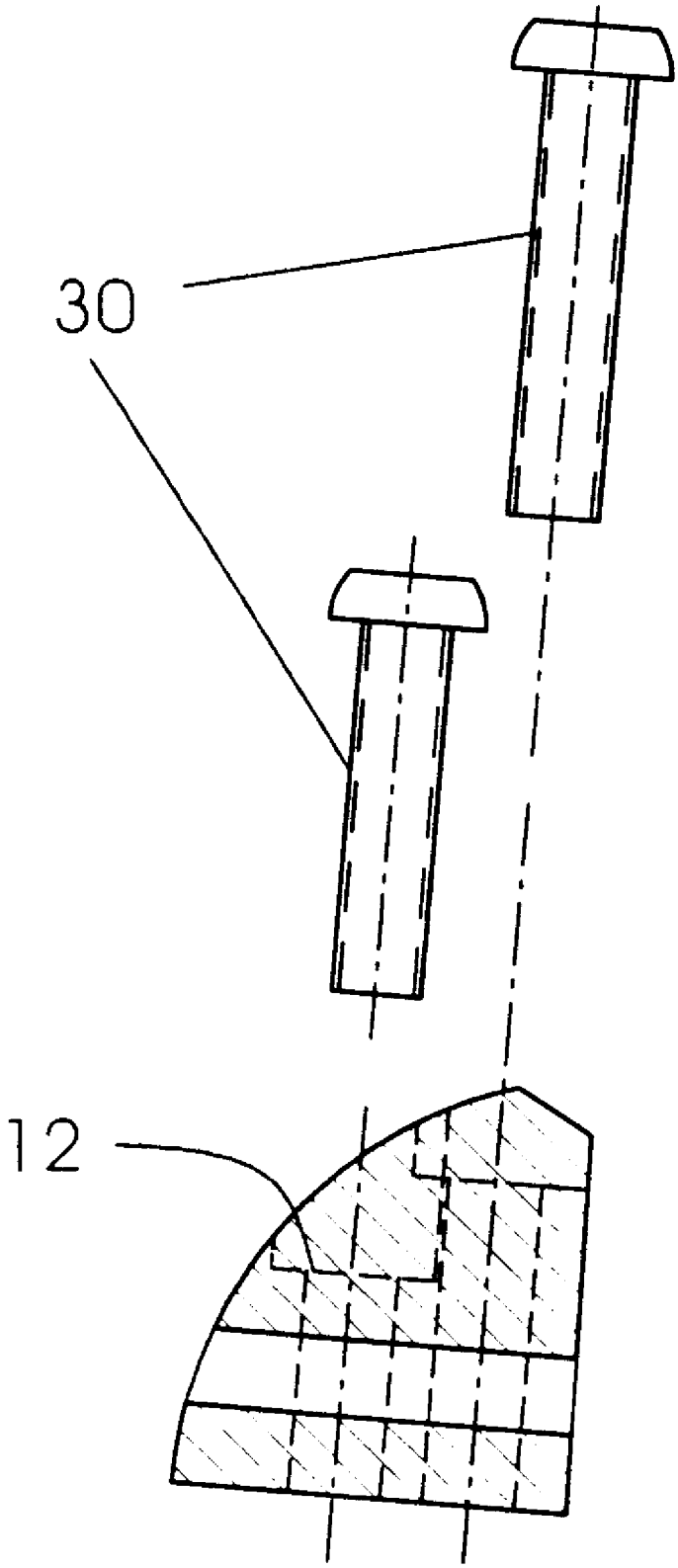
Fig.2.2

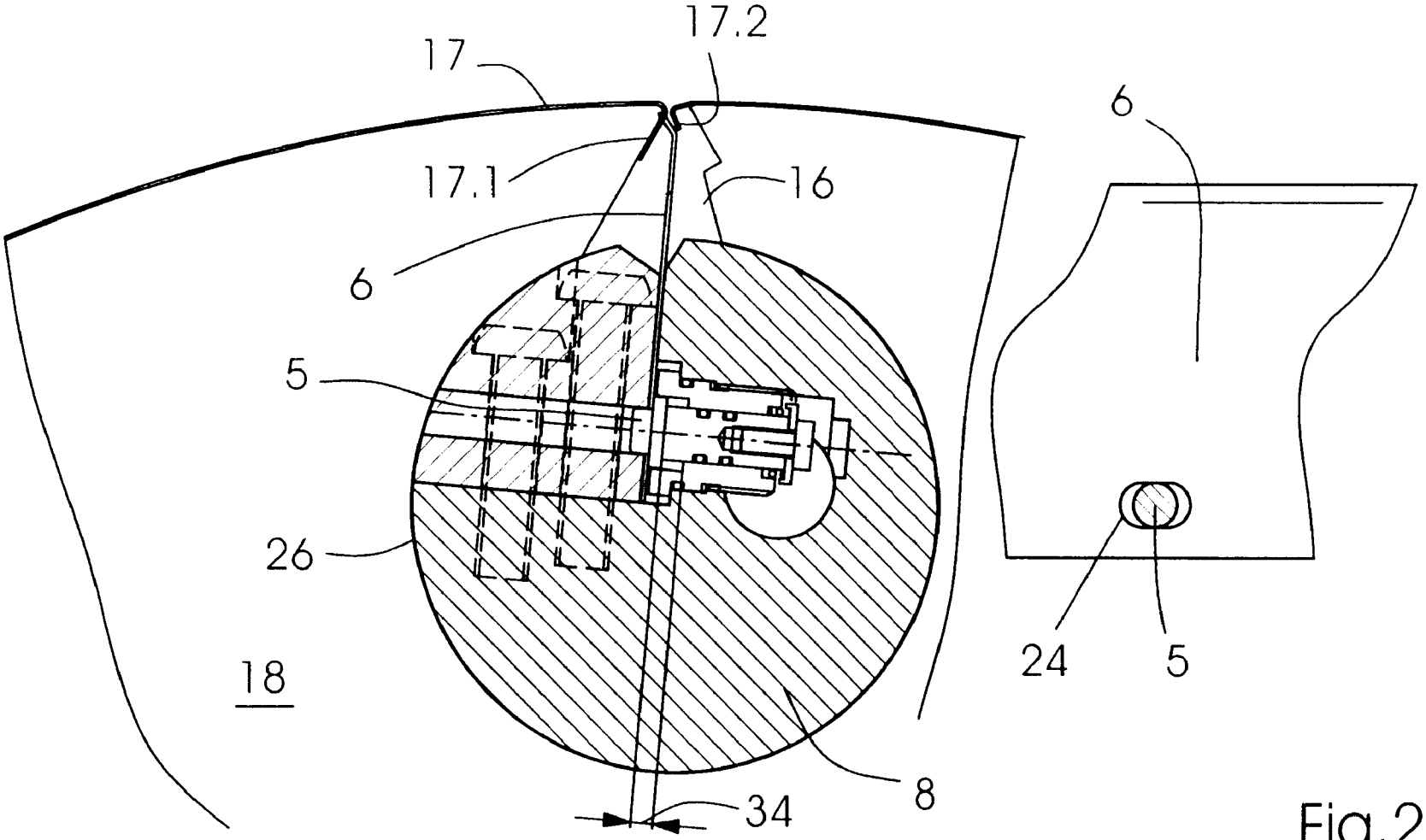
Fig.2.3

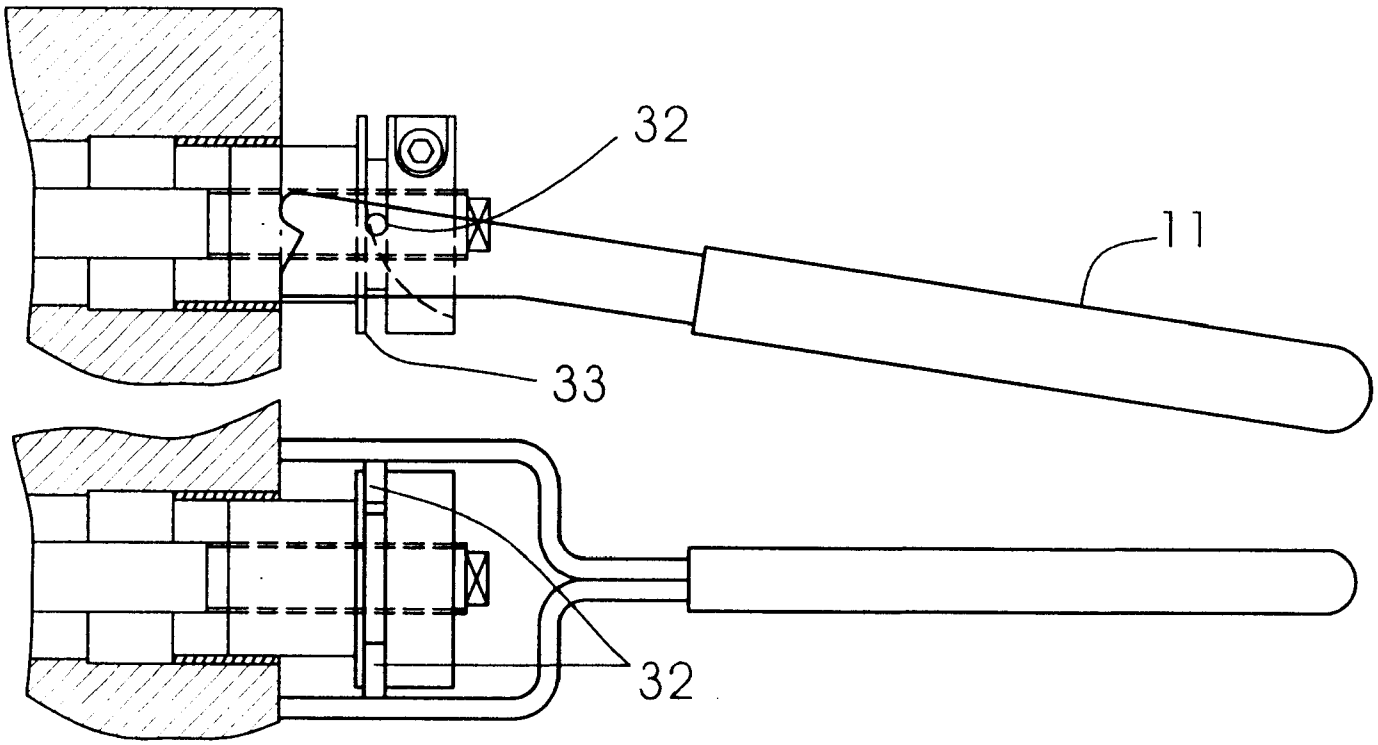
Fig.3.1

FLUID-LOADED TENSIONING DEVICE FOR PRINTING FORMS ON ROTARY PRINTING MACHINES

BACKGROUND OF THE INVENTION

Field of the Invention

The invention relates to a fluid-loadable tensioning device for printing forms on rotary printing machines, whether sheet-processing or web-processing rotary printing machines for recto printing, recto/verso printing, newsprinting or also job printing.

The published European Patent Document EP 0 842 773 A1 is concerned with a reusable winding core for rotary printing machines. A reusable winding reel is provided which is intended for a plate cylinder of a rotary printing machine. The winding core is formed of two halfshells which are assembled in a manner for producing two slotlike orifices located opposite one another. Within a tubular sleeve part formed of the two halfshells there is provided a control element which is adjustable so that the outside diameter of the winding core can be changed. Preferably, the winding core is pre-set to an outside diameter so that it becomes possible for plate material to be wound up from a supply reel. In order to disassemble the winding core from the interior of a printing unit cylinder of a rotary printing machine, the winding core diameter can be changed by a control element so that it becomes possible to extract the winding core reel easily from the interior of a plate cylinder of a rotary printing machine. U.S. Pat. No. 5,735,211 is concerned with a clamping and tensioning device for printing forms on rotary printing machines. In the construction described in this patent, the clamping device for holding a printing form in a defined position in relation to a printing form cylinder is received within a tensioning device, by which the clamping device is itself capable of being moved as a whole relative to the surface of the printing form cylinder, in order, on the one hand, to tension the printing form with respect to a tensioning gap or, on the other hand, to detension the printing form on the circumference of the printing form cylinder. A piston arrangement is provided, by which one of the two edges of the printing form can be pressed in the direction of the tensioning gap.

Finally, the published European Patent Document EP 0 884 176 A1 is concerned with a clamping device for a rubber blanket on a transfer cylinder of a rotary printing machine. In this development, a rubber blanket reinforced by a metal layer is tautened onto a transfer cylinder in the printing unit of a rotary printing machine. The rubber blanket to be accepted on the transfer cylinder is formed with a slit. Tensioning edges are formed on the metal layer and can be tensioned in a tensioning gap of a transfer cylinder. A dressing including compressible elastomers is fastened onto the upper side of the metal layer. The elastic dressing is provided with a surface which is suitable for the transfer of ink onto a print carrier. Furthermore, the dressing is provided with a nonslip coating which extends over part of the metal layer in one of the edge regions, in order to maintain the position of the dressing on the surface of the transfer cylinder during the rotation of the transfer cylinder. The nonslip layer has a higher coefficient of friction than that of the metal layer, and a thickness that is of a dimension sufficient for pushing the ends of the metal layer into the tensioning gap of the published European Patent Document EP 0 884 176 A1 is also concerned, furthermore, with a method for fastening a cylinder dressing on the transfer cylinder in the printing unit.

SUMMARY OF THE INVENTION

Starting from the prior art outlined hereinabove, it is an object of the invention to provide a fluid-loaded tensioning device for printing forms on rotary printing machines which serves, on one hand, for reliably interlocking tensioning elements for a printing form and, on the other hand, for ensuring that the tensioning elements are readily exchangeable.

With the foregoing and other objects in view, there is provided in accordance with one aspect of the invention, a tensioning device for a printing form on a jacket surface of a printing unit cylinder in a printing unit of a rotary printing machine, the printing unit cylinder being formed with a tensioning gap for receiving ends of the printing form therein, a tensioning shaft being received in a bore formed in the printing unit cylinder, the tensioning shaft being held under pretensioning by tensioning elements, comprising fluid-loaded cylinders disposed on the tensioning shaft for respectively locking and unlocking a tensioning element on the tensioning shaft, and a separate actuating cylinder for setting an operating pressure of the fluid-loaded cylinders.

In accordance with another feature of the invention, the tensioning shaft is formed with a bore connected in terms of pressure via a pressure line to a piston element of the separate actuating cylinder.

In accordance with a further feature of the invention, a piston element received in the separate actuating cylinder is connected to a force accumulator.

In accordance with an added feature of the invention, the tensioning device includes a chamber surrounding the piston element of the separate actuating cylinder, the chamber being pressure-loadable via a supply line.

In accordance with yet another feature of the invention, an axial actuating movement of the piston element of the actuating cylinder serves for generating a negative pressure in the bore formed in the tensioning shaft.

In accordance with yet a further feature of the invention, the bore and the actuating cylinder of the tensioning shaft are provided with aerating and deaerating bores, respectively.

In accordance with yet an added feature of the invention, the piston element has a part thereof formed with a diameter for controlling a fluid system formed of the bore in the tension shaft and the pressure line, the diameter being considerably smaller than the diameter of the rest of the piston element in the actuating cylinder.

In accordance with yet an additional feature of the invention, the piston element, when operative, releases the tensioning element on the tensioning shaft.

In accordance with still another feature of the invention, the piston element, when operative, causes a locking mechanism to move back out of said orifices formed in the tensioning element.

In accordance with still a further feature of the invention, the tensioning shaft and the separate actuating cylinder are received in orifices disposed independently of one another on the printing form cylinder.

In accordance with still an added feature of the invention, the tensioning device for a printing form includes a device disposed on one end face of the cylinder for manually operating the piston element.

In accordance with still an additional feature of the invention, the manually operating device includes a slotted guide for transmitting a tensile force.

In accordance with another feature of the invention, the tensioning device for a printing form includes a spring-loaded actuating element disposed on an end face of the cylinder for maintaining constant the tension of the printing form on the printing unit cylinder.

In accordance with a further aspect of the invention, there is provided a printing unit cylinder in the printing unit of a rotary printing machine, with a tensioning device for a printing form on a jacket surface of the printing unit cylinder, the printing unit cylinder being formed with a tensioning gap for receiving ends of the printing form therein, a tensioning shaft being received in a bore formed in the printing unit cylinder, the tensioning shaft being held under pretensioning by tensioning elements, comprising fluid-loaded cylinders disposed on the tensioning shaft for respectively locking and unlocking a tensioning element on the tensioning shaft, and a separate actuating cylinder for setting an operating pressure of the fluid-loaded cylinders.

In accordance with an added aspect of the invention, there is provided a printing unit of a rotary printing machine, with at least one printing unit cylinder formed with a tensioning gap for receiving ends of the printing form therein, a tensioning shaft received in a bore formed in the printing unit cylinder, the tensioning shaft being held under pretensioning by tensioning elements, comprising fluid-loaded cylinders disposed on the tensioning shaft for respectively locking and unlocking a tensioning element on the tensioning shaft, and a separate actuating cylinder for setting an operating pressure of the fluid-loaded cylinders.

In accordance with a concomitant feature of the invention, there is provided a printing unit cylinder in a printing unit of a rotary printing machine, cooperatively engaging with a transfer cylinder having a gapless covering disposed thereon, the printing unit cylinder being formed with a tensioning gap for receiving ends of the printing form therein, a tensioning shaft received in a bore formed in the printing unit cylinder, the tensioning shaft being held under pretensioning by tensioning elements, comprising fluid-loaded cylinders disposed on the tensioning shaft for respectively locking and unlocking a tensioning element on the tensioning shaft, and a separate actuating cylinder for setting an operating pressure of the fluid-loaded cylinders.

There are diverse advantages which can be afforded by the invention according to the instant application. The release of the edges of a printing form and the release of a tensioning element received in the tensioning gap of a printing unit cylinder can now be performed without requiring a tool, and without having to carry out initially a complicated removal of the mechanism in the periphery of the tensioning gap. Through the intermediary of a pneumatically operatable actuating cylinder embedded in the printing form cylinder, an extremely rapid response of a fluid system independent of the pneumatics can be achieved. The relatively long actuating travel distance of a piston element provided in the actuating cylinder can be converted into a plurality of adjusting operations taking place simultaneously in the tensioning gap of a printing form cylinder. The simultaneous execution of the unlocking movement can follow extremely quickly, so that it is possible to remove the released tensioning element from the tensioning gap in a very simple manner. The tensioning element is locked in the tensioning gap by a force accumulator displaced in the actuating cylinder, so that, even if the pneumatics fail, the arrest or retention of the tensioning element remains assured.

In a further embodiment of the concept upon which the invention is based, the actuating cylinder in the printing form cylinder is connected via a pressure line to a bore formed in the tensioning shaft for the tensioning element. The separation of the spatial arrangement of the actuating cylinder and the fluid system for locking and unlocking the tensioning element on the tensioning shaft permits rather simple manufacture, because sufficient construction space is available on the printing form cylinder. The separate actuating cylinder is provided with a piston element which is loaded by a force accumulator. Via a piston surface, the force accumulator acts upon the fluid contained in the fluid system and loads the latter in a manner that the interlocking of the tensioning elements is assured at all times during the rotation of the printing unit cylinder. On the other hand, the piston element is loaded via a pressure delivery line terminating separately in the actuating cylinder, in order to produce a pressure drop in the fluid system operating the tensioning element.

Due to the pressure drop capable of being generated in the fluid system made up of the bore passing through the tensioning shaft, and the flexible outer supply line, the bolt elements locking the tensioning element are withdrawn and release orifices in formed the tensioning element, with the result that it becomes possible for the tensioning element to be removed from the tensioning gap of the printing form cylinder.

The piston element in the actuating cylinder has formed thereon, on the one hand, the active surface which controls the movement of the locking/unlocking elements and, on the other hand, also the surface which, loaded by a pressure capable of being generated pneumatically, moves the piston surface acting upon the fluid system.

In order to uncouple the control systems inside the printing form cylinder, the actuating cylinder and the tensioning shaft are accommodated on one side of the printing unit cylinder in installation spaces independent of one another. The systems are connected to one another via a high-pressure line lying outside on the end face of the printing unit cylinder.

For manual operation of the actuating cylinder, a lever element may be provided on the opposite end face of the printing form cylinder and, co-operating with a slotted guide, ensures the manual movability of the piston element, so that the latter can also be operated manually in an emergency. The device according to the invention can be incorporated in a printing unit cylinder, the latter being capable of being used both in the printing unit of a sheet-processing rotary printing machine and in the printing unit of a web-processing rotary printing machine. Furthermore, a printing unit cylinder equipped with the device proposed in accordance with the invention can be used perfectly well in a printing unit having a transfer cylinder which is provided with a gapless covering exchangeable through an orifice or opening formed in the side wall of the printing unit.

Other features which are considered as characteristic for the invention are set forth in the appended claims.

Although the invention is illustrated and described herein as embodied in a fluid-loaded tensioning device for printing forms on rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2.1 is an enlarged fragmentary view, partly exploded, of FIG. 1, showing a locking/unlocking element embedded in a tensioning shaft;

FIG. 2.2 is a cross-sectional view of an insert to the tensioning shaft, with fastening screws shown in an exploded view;

FIG. 2.3 is a view combining those of FIGS. 2.1 and 2.2 and showing the insert fastened to the tensioning shaft with a tensioning element received therebetween;

FIG. 3.1 is a fragmentary view of FIG. 3, showing a mock-up serving for manually moving a piston element forming part of the invention.

DESCRIPTION OF THE PREFERRED EMBODIMENTS

Figure 1:
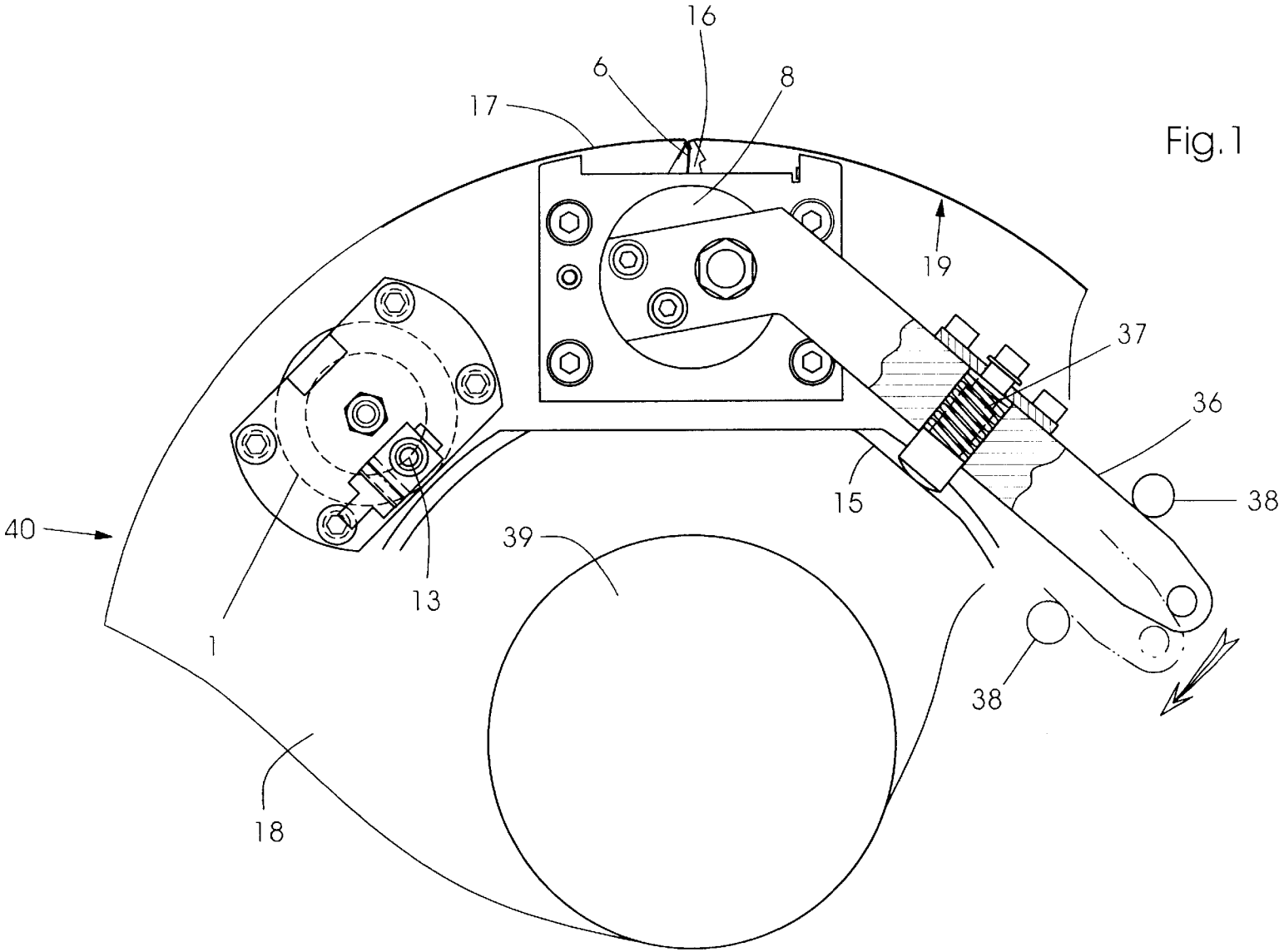
FIG. 1 is a fragmentary end view of a printing form cylinder for holding a printing form.

Referring now to the drawings and, first, particularly to FIG. 1 thereof, there is shown therein an end face of a printing form cylinder having a circumferential surface to which a flexible printing form can be secured. A printing unit cylinder 18, which is mounted by cylinder journals 39 thereof arranged, respectively, on the end faces of the cylinder 18, in a printing unit of a rotary printing machine, is formed with a tensioning gap 16. Leading and trailing edges 17.1 and 17.2, respectively, (note FIG. 2.1) of a printing form 17 are suspended from walls of the printing unit cylinder 18, which define the tensioning gap 16, the trailing edge 17.2 of the printing form 17 being tensioned by a tensioning element 6 provided on a tensioning shaft 8 (note FIG. 2.3, particularly). The tensioning shaft 8 is connected on the end face 40 of the printing unit cylinder 18 to a lever extension 36. The lever extension 36, in turn, is movable between two stops 38 and can be held under pretensioning by a spring-loaded actuating element 37 which is supported on a stop surface 15. As a result, the printing form 17, which is received on the circumferential surface 19 of the printing unit cylinder 18, can be kept under constant tension.

The printing form 17, tension-mounted with the edge regions 17.1 and 17.2 thereof in the tensioning gap 16 lies on the circumferential surface 19 of the printing unit cylinder 18 and is supported over the entire area thereof by this circumferential surface 19. At the end face 40 of the printing unit cylinder 18 according to FIG. 1 there are provided, separated from one another spatially, in respective bores formed in the printing unit cylinder 18, an actuating cylinder 1, which is loadable by a pneumatic connection 13, and a tensioning shaft 8 which extends over the entire width of the printing unit cylinder 18.

FIG. 2.1 shows, in an exploded view, a locking/unlocking element embedded in the tensioning shaft 8 and of an insert 12.

The locking/unlocking element 2 includes a bolt element 5 having a diameter 23. The bolt element 5 is surrounded by a sleeve 41, whereon a spring element 10 and a stop washer 14 are provided. Annular elements 27 and 28 are provided between the bolt 5 and the spring element 10, in order to achieve better sealing at the locking/unlocking element 2. The thus configured locking/unlocking elements 2 on the tensioning shaft 8 project into a bore 35 passing through the tensioning shaft 8, and are operated by a pressure drop in the bore 35. The tensioning shaft 8 is formed with a diameter 26 which matches the diameter 25 of a bore formed in the printing unit cylinder 18. The tensioning gap 16, opening or widening trapezoidally towards the tensioning shaft 8, receives the two ends or edges 17.1 and 17.2 of the printing form 17. In this regard, the trailing edge 17.2 of the printing form 17 is gripped by a tensioning element 6, illustrated in isolation, and is subjected to tension on the circumference of the printing unit cylinder 18.

In FIG. 2.1, an insert 12 which is likewise fastened to the tensioning shaft 8 is illustrated. As shown in FIGS. 2.2 and 2.3, the insert 12, which is formed as an approximately quarter-circle in cross section, is provided with passage bores in the region of the locking/unlocking cylinder 2 mounted on the tensioning shaft 8. The insert 12 can be screwed to the tensioning shaft 8 by fastening elements 30. As a result, a slotlike orifice is formed between the quarter-circular insert 12 and that end face of the tensioning shaft 8 into which the tensioning element 6 is capable of being introduced, and the locking/unlocking cylinder 2 can be locked by an outward movement that is effected, for example, hydraulically.

FIG. 2.3 is a cross-sectional view of a pre-assembled tensioning shaft 8 embedded in the printing unit cylinder 18. The insert 12, which extends over the width of the tensioning shaft 8 and is formed with a quarter-circular cross section, is connected to the tensioning shaft 8 via fastening elements in the form of screws 30. Embedded in the slotlike orifice between the insert 12 and the end face of the tensioning shaft 8 is a tensioning element 6 which, in the configuration that is illustrated, is locked by the head of the bolt 5 which is arranged in line with a passage bore formed in the insert 12. The actuating travel 34 which the head of the bolt 5 traverses in order to lock and unlock the tensioning element 6 is represented by the space between the two opposing arrows at 34; in the event of a pressure drop in the bore 35 passing through the tensioning shaft 8, the stop washer 14, loaded by the spring element 10, moves out on the locking/unlocking cylinder 2 and consequently displaces the head of the bolt 5 out of an orifice 24 in the tensioning element 6 (note FIG. 2.3). Because the pressure drop takes place in the bore 35 of the tensioning shaft 8, all the locking/unlocking cylinders 2 simultaneously move back out of the orifices 24 of the tensioning element 6, so that the pressman, after removing a previously detensioned printing form 17, can extract the tensioning element 6 from the outer surface of the printing unit cylinder 18 and, if appropriate, exchange it for a new tensioning element 6.

Figure 3:
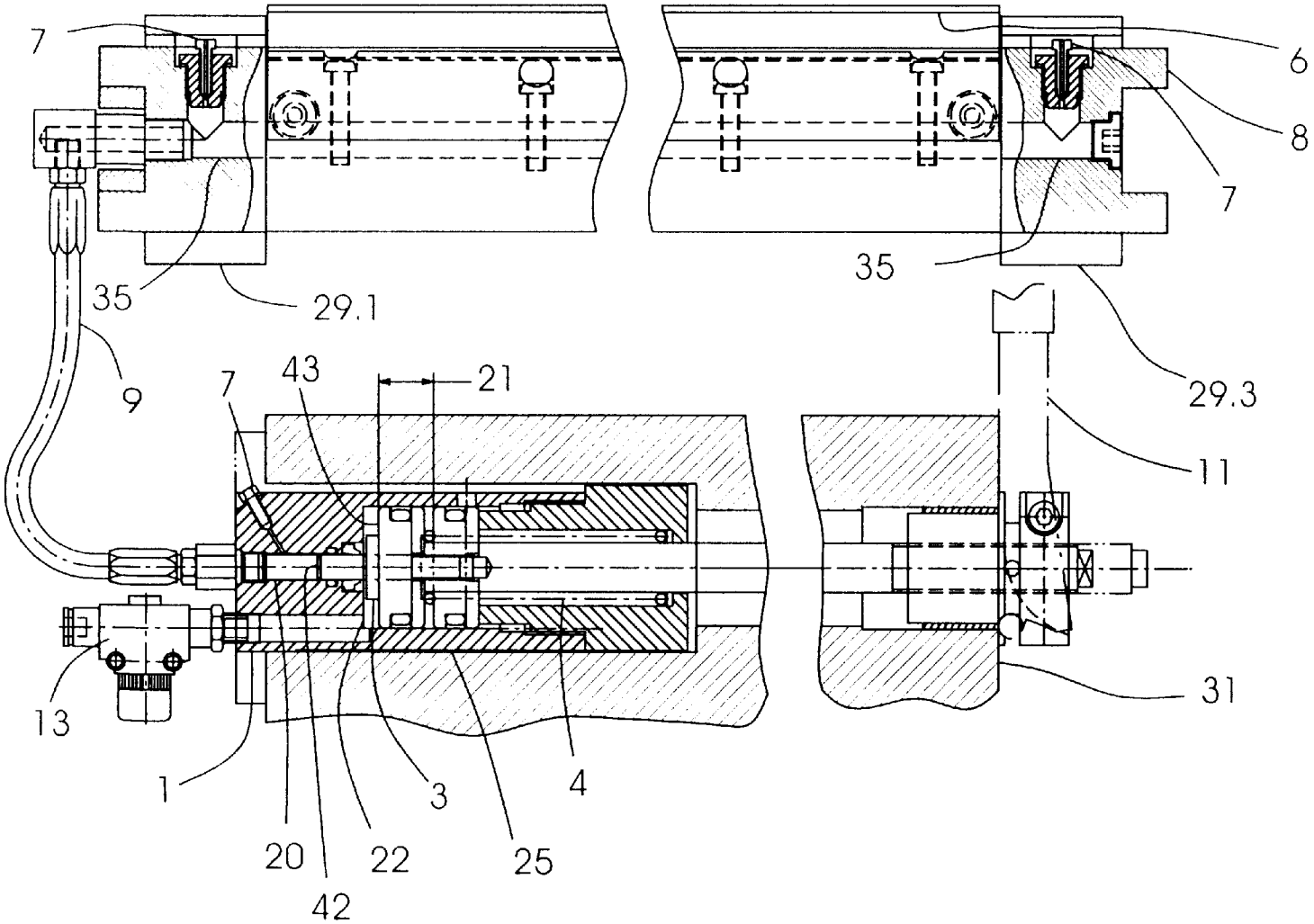
FIG. 3 is a plan view, partly broken away and in section, of mutually coupled components of the tensioning device according to the invention for printing forms.

FIG. 3 illustrates the components of the tensioning device for printing forms 17, the components being coupled to one another by pressure and being accommodated separately from one another spatially in the printing unit cylinder 18.

The actuating cylinder 1 includes a piston element 3 with two active surfaces 42 and 43. The one surface 42 of the piston element 3 projects into a high-pressure line 9 which runs along the end face of the printing form cylinder 18 on the outside and is connected to the bore 35 in the tensioning shaft 8. The piston element 3, furthermore, includes an active surface 43 for a pressure which is applied via a pneumatic connecting piece 13 to the chamber of the actuating cylinder 1, which surrounds the piston element 3. On that side of the piston element 3 which faces away from the connections of the lines 9 and 13, there is provided a force accumulator or storage device 4, for example, in the form of a helical spring, which is secured against kinking by a rodlike element, via which the piston element 3 is loaded continuously. As a result, an appropriately dimensioned hydraulic pressure is generated via a fluid system 9, 35 on the tensioning shaft 8 and on the locking/unlocking cylinders 2 connected to the tensioning shaft in the latter, and ensures continuous interlocking of the tensioning element 6 by the tensioning shaft 8 during the rotation of the printing unit cylinder 18.

During rotational operation, the tensioning element 6 is accordingly arrested mechanically, only the unlocking of the latter on the tensioning shaft 8 being effected by a pressure fluid. When the chamber surrounding the piston element 3 and located in the actuating cylinder 1 is loaded with compressed air by the pneumatic connection 13, the piston element 3 moves back along the actuating travel distance 21 counter to the action of the force accumulator 4. A piston part of the piston element 3, the diameter 20 of which is considerably smaller than the diameter 22 of the rest of the piston element 3, thereby moves out of the high-pressure line 9 of the fluid system 9, 35 and effects a pressure drop thereat. The pressure drop acts upon all of the locking/unlocking cylinders 2 which are connected by pressure to the bores 35 of the fluid element which pass through the tensioning shaft 8. The compression springs provided on the locking/unlocking cylinders 2 cause the bolts 5 to move along the travel distance 34 out of the orifices 24 of the tensioning element 6, and unlock the latter.

The bore 35 passing through the tensioning shaft 8 can be opened and closed via deaerating and aerating bores 7 provided on the end faces of the tensioning shaft 8. The tensioning 5 shaft 8 has, on the end faces thereof, mounting rings 29.1 and 29.3, respectively, by which the shaft 8 can be received rotatably in the printing form cylinder 18.

The force accumulator 4 loading the piston element 3 is preferably so dimensioned that the pressure generated by the force accumulator in the fluid system 9, 35 allows a reliable movement of all the locking/unlocking cylinders 2, for example, approximately 70 bar. Provided on that end face 31 of the printing unit cylinder 18 which is located opposite the 15 actuating cylinder 1 is a lever element 11 which is illustrated in phantom, i.e., by dot-and-dash lines in FIG. 3. Deaerating elements 7 are provided in the bore 35, in order to allow compressed air to escape.

A mock-up of a lever element 11, in particular of the function thereof of unlocking or locking the tensioning element 6 on the tensioning shaft 8, is apparent in greater detail from the illustration thereof in FIG. 3.1.

The rodlike component securing the force accumulator 4 against kinking is provided, on the end face 31 of the printing unit cylinder 18, with a peripheral groove 33, into which a pin 32 of a fork 11 engages. The pin 32 on the fork 11 can be applied in a simple way to the circumferential groove 33 so that, as a result of a rotational movement of the fork 11 according to the arrow depicted in FIG. 3.1, a withdrawal of the rodlike component and, therefore, a backward movement of the piston element 3 in the printing unit cylinder 18 take place. The peripheral groove 33 and the pin 32 of the fork co-operate in the manner of a slotted or sliding-block guide and draw the rodlike element, whereon the piston element 3 is received, towards the end face 31. The piston part 20 thereby moves out of the fluid system 9, 35, so that the desired pressure drop in the fluid system 9, 35 occurs, the bolt heads 5 move back out of the orifices 24 of the tensioning element 6, and consequently the stop washers 14 move into the bore 35. At this instant of time, the tensioning element 6 is released and can be readily extracted from the tensioning shaft 8.

Figure 4:
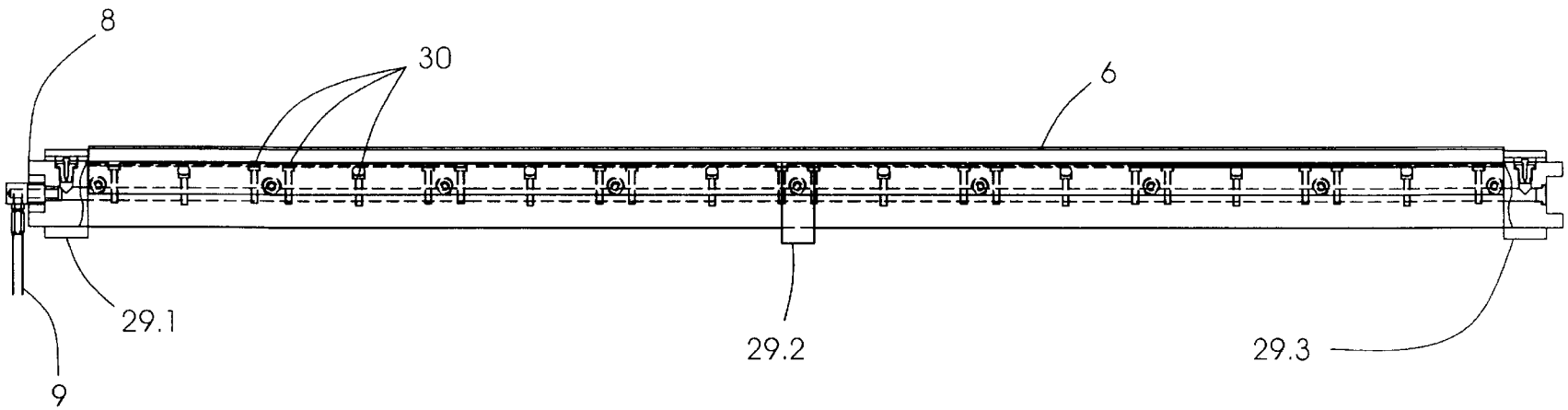
FIG. 4 is a complete plan view of the tensioning shaft according to the invention to be embedded in a printing unit cylinder.

FIG. 4 illustrates the tensioning shaft 8 extending from the end face 40 to the end face 31. The insert 12 is connected to the tensioning shaft 8 via screws 30. The tensioning shaft 8 is mounted in the printing unit cylinder 18 at three mounting points 29.1, 29.2 and 29.3; the high-pressure line of the fluid system 9, 35, which loads the bore 35, is assigned to one end of the tensioning shaft 8.

In addition to using the tensioning device according to the invention on sheet-processing rotary printing machines, it can also be employed readily on web-processing machines for newsprinting or job printing, wherever a rapid or accurate change in a number of printing forms 17 is necessary due to a change in orders.

We claim:

1. A tensioning device for a printing form on a jacket surface of a printing unit cylinder in a printing unit of a rotary printing machine, the printing unit cylinder being formed with a tensioning gap for receiving ends of the printing form therein, the tensioning device comprising:

a spring-loaded actuating element;

a tensioning shaft adapted to be received in a bore formed in the printing unit cylinder, the tensioning shaft having a tensioning element disposed thereon and being held under pretensioning by said spring-loaded actuating element;

fluid-loaded cylinders having an operating pressure, and being disposed on the tensioning shaft for respectively locking and unlocking said tensioning element on said tensioning shaft; and a separate actuating cylinder for setting the operating pressure of said fluid-loaded cylinders.

2. The tensioning device for the printing form according to claim 1, comprising a piston element received in said separate actuating cylinder said piston element being connected to a force accumulator.

3. The tensioning device for the printing form according to claim 1, further comprising a pressure line, said separate actuating cylinder including a piston element and said tensioning shaft being formed with a bore connected by pressure via said pressure line to said piston element of said separate actuating cylinder.

4. The tensioning device for the printing form according to claim 3, further comprising a chamber surrounding said piston element of said separate actuating cylinder, said chamber being pressure-loadable via a supply line.

5. The tensioning device for the printing form according to claim 3, wherein an axial actuating movement of said piston element of said actuating cylinder serves for generating a negative pressure in said bore formed in said tensioning shaft.

6. The tensioning device for the printing form according to claim 3, wherein said bore of said tensioning shaft and said actuating cylinder are provided with aerating and deaerating bores, respectively.

7. The tensioning device for the printing form according to claim 3, wherein said piston element has a part thereof formed with a diameter for controlling a fluid system formed of said bore in said tensioning shaft and said pressure line, said diameter being considerably smaller than a diameter of the rest of said piston element in said actuating cylinder.

8. The tensioning device for the printing form according to claim 5, wherein said piston element, when operative, releases said tensioning element on said tensioning shaft.

9. The tensioning device for the printing form according to claim 8, which further comprises a locking mechanism, said piston element, when operative, causing said locking mechanism to move back out of orifices formed in said tensioning element.

10. The tensioning device for the printing form according to claim 3, including a device adapted to be disposed on one end face of the printing unit cylinder for manually operating said piston element.

11. The tensioning device for the printing form according to claim 10, wherein said manually operating device includes a slotted guide for transmitting a tensile force.

12. The tensioning device for the printing form according to claim 1, wherein said spring-loaded actuating element is adapted to be on an end face of the printing unit cylinder for maintaining constant the tension of the printing form on the printing unit cylinder.

13. A printing unit cylinder for use in a printing unit of a rotary printing machine, comprising;

a cylinder body;

said cylinder body having a tensioning gap formed therein for receiving ends of a printing form therein;

said cylinder body having a bore formed therein;

a tensioning shaft being received in said bore;

a tensioning element positioned on said tensioning shaft;

a spring-loaded actuating element;

said tensioning shaft being held under pretensioning by said spring-loaded actuating element;

fluid-loaded cylinders having an operating pressure and being disposed on said tensioning shaft for respectively locking and unlocking said tensioning element on said tensioning shaft; and a separate actuating cylinder for setting the operating pressure of said fluid-loaded cylinders.

14. The printing unit cylinder according to claim 13, wherein said printing unit cylinder has an orifice disposed independently of the bore holding said tensioning shaft and said separate actuating cylinder is received in said orifice.

15. A printing unit of a rotary printing machine, comprising:

at least one printing unit cylinder;

said printing unit cylinder having a tensioning gap formed therein for receiving ends of a printing form therein;

said printing unit cylinder having a bore formed therein;

a tensioning shaft being received in said bore;

a tensioning element positioned on said tensioning shaft;

a spring-loaded actuating element;

said tensioning shaft being held under pretensioning by said spring-loaded actuating element;

fluid-loaded cylinders having an operating pressure and being disposed on said tensioning shaft for respectively locking and unlocking said tensioning element on said tensioning shaft; and a separate actuating cylinder for setting the operating pressure of said fluid-loaded cylinders.

16. The printing unit according to claim 15, wherein said printing unit cylinder has an orifice disposed independently of the bore holding said tensioning shaft and said separate actuating cylinder is received in said orifice.

17. In a printing unit of a rotary printing machine, at least one printing unit cylinder cooperatively engaging with a transfer cylinder having a gapless covering disposed thereon, the printing unit cylinder comprising:

a cylinder body;

said cylinder body having a tensioning gap formed therein for receiving ends of the printing form therein;

said cylinder body having a bore formed therein;

a tensioning shaft being received in said bore;

a tensioning element positioned on said tensioning shaft;

a spring-loaded actuating element;

said tensioning shaft being held under pretensioning by said spring-loaded actuating element;

fluid-loaded cylinders having an operating pressure and being disposed on said tensioning shaft for respectively locking and unlocking said tensioning element on said tensioning shaft; and a separate actuating cylinder for setting the operating pressure of said fluid-loaded cylinders.

18. The printing unit cylinder according to claim 17, wherein said printing unit cylinder has an orifice disposed independently of the bore holding said tensioning shaft and said separate actuating cylinder is received in said orifice.

* * * * *